US005376044A

United States Patent [19]

Tippin et al.

[11] Patent Number: 5,376,044

[45] Date of Patent: Dec. 27, 1994

[54] VENTILATOR

[75] Inventors: Arthur D. Tippin, Birmingham; Tracy D. Fletcher, Willenhall, both of England

[73] Assignee: Hardware & Systems Patents Limited, England

[21] Appl. No.: 87,271

[22] Filed: Jul. 8, 1993

[30] Foreign Application Priority Data

Jul. 15, 1992 [GB] United Kingdom ..... 9215038

[51] Int. Cl.[5] ..... E06B 7/02; F24F 13/18

[52] U.S. Cl. ..... 454/211; 251/303; 454/195; 454/213

[58] Field of Search ..... 454/195, 211, 213, 273, 454/276, 333, 196; 251/303, 73, 298, 242

[56] References Cited

U.S. PATENT DOCUMENTS

| | | | |
|---|---|---|---|
| 1,609,409 | 12/1926 | Hubbard | 454/213 X |
| 2,804,008 | 8/1957 | Koch . | |
| 2,871,523 | 2/1959 | Negoro | 454/195 X |

FOREIGN PATENT DOCUMENTS

| | | | |
|---|---|---|---|
| 5163 | 6/1894 | Sweden | 454/273 |
| 190573 | 4/1937 | Sweden | 251/303 |
| 1250092 | 9/1967 | United Kingdom . | |
| 1417751 | 12/1975 | United Kingdom | 454/211 |
| 1519342 | 7/1978 | United Kingdom . | |
| 2136106 | 9/1984 | United Kingdom . | |
| 2241572 | 9/1991 | United Kingdom . | |

*Primary Examiner*—Harold Joyce
*Attorney, Agent, or Firm*—Larson and Taylor

[57] ABSTRACT

A two-part plastics ventilator comprises a housing defining a ventilation opening, a flap pivotal to open and close the opening, and spring legs integral with the housing to bias the flap to the open and closed positions.

10 Claims, 4 Drawing Sheets

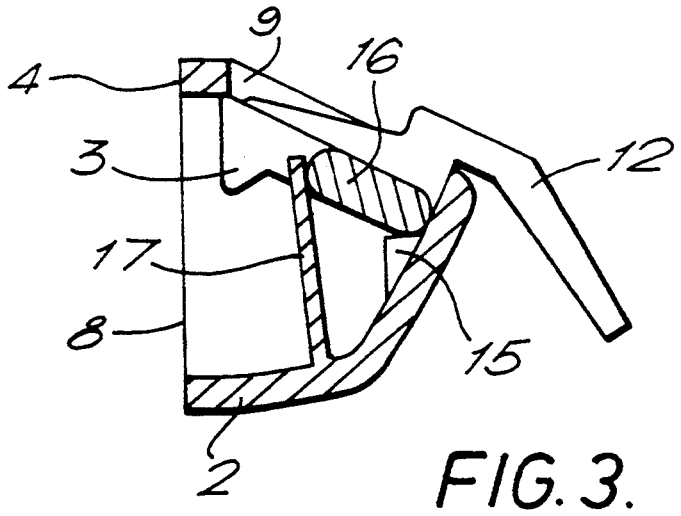
FIG. 3.
FIG. 4.
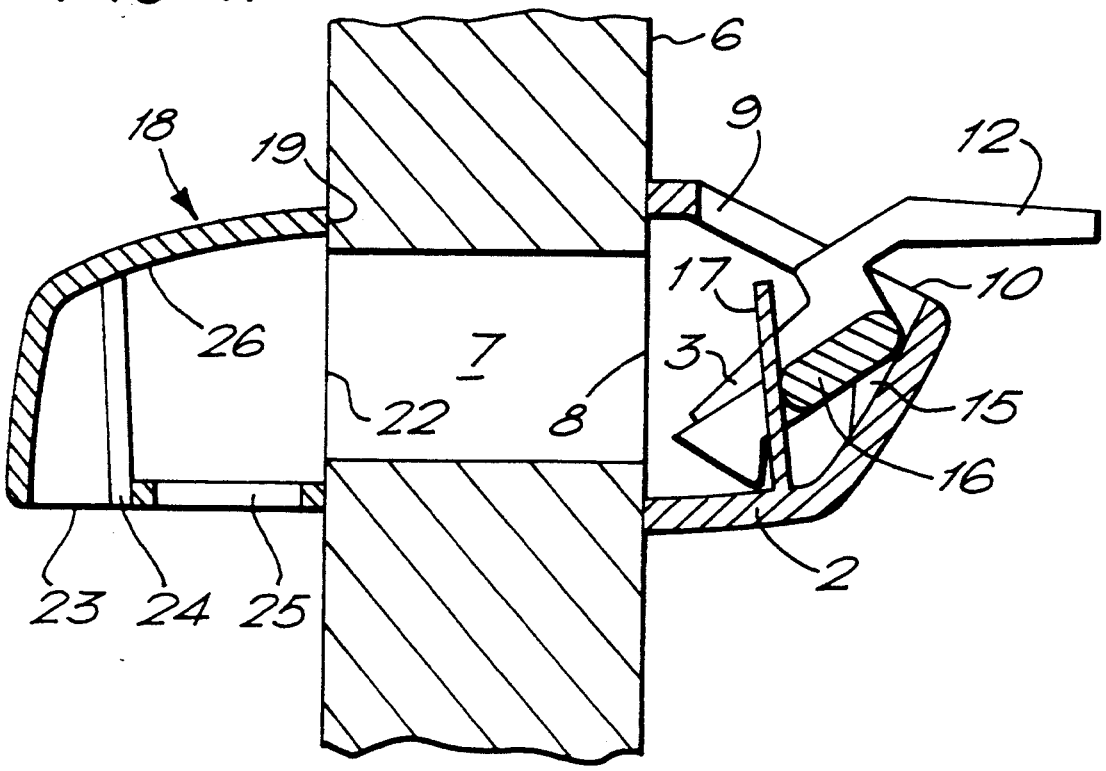

VENTILATOR

BACKGROUND OF THE INVENTION

This invention concerns improvements in or relating to ventilators for controlling air flow and in particular, though not exclusively, for controlling air flow through an air path formed in a frame of a door or window.

Ventilators are known in which a flap is pivotal to open and close a ventilation opening to control air flow through an air path formed in door or window frames. The design and construction of such ventilators is often complex requiring manufacture and assembly of several parts which increases the cost.

In use, the ventilator is mounted on the inner face of the frame and an exterior hood is often mounted on the outer face of the frame to prevent water penetration. It is usual to fit a fine mesh or the like within the hood to exclude insects but this reduces the cross-sectional area of the ventilation opening so that the ventilation opening has to be made larger than required to obtain the necessary air flow.

The present invention has been made from a consideration of the above problems.

SUMMARY OF THE INVENTION

According to one aspect of the invention there is provided a ventilator comprising an elongate housing defining a ventilation opening and an elongate flap mounted for pivotal movement to open and close the ventilation opening characterised in that the housing has integral spring means arranged to bias the flap to each of two end positions in which the ventilation opening is open and closed respectively.

By this aspect of the invention, the construction of the ventilator is very simple with there being only two parts for manufacture and assembly.

When used to control air flow through an air path formed in the frame of a door or window, the housing is mounted on the inner face of the frame to overlie the air path, for example a through slot or holes, extending between the inner face and the outer face of the frame.

The ventilator is usually mounted horizontally with the ventilation opening arranged to direct the airflow either downwards or upwards but other mounting positions may be used if horizontal mounting is precluded.

The integral spring means is conveniently provided by at least one spring leg engageable with the flap to bias it to each of the end positions. More preferably, the flap is biased by a respective spring leg at each end.

According to another aspect of the invention there is provided an exterior hood for a ventilator comprising an elongate housing defining a ventilation opening characterised in that the housing has an integral internal apertured grill having first and second longitudinally extending portions angled relative to each other.

By this aspect of the invention, the cross-sectional area of the apertures in the grill can be made equal to that of the ventilation opening so that air flow is not restricted by the provision of the grill.

When used with a ventilator mounted on the inner face of the frame of a door or window, the hood is mounted on the outer face of the frame to overlie the air path through the frame.

The hood is usually mounted horizontally with the ventilation opening in the underside to exclude rain.

The grill apertures may be of any suitable shape and size to prevent entry of insects with slots being preferred.

Other features, benefits and advantages of the invention in each of its aspects will be apparent from the following description of an exemplary embodiment with reference to the accompanying drawings.

BRIEF DESCRIPTION OF THE DRAWINGS

FIG. 3 is a section on the line 3—3 of FIG. 2;

FIG. 4 is a sectional view showing the ventilator mounted on the inner face of a window frame with the flap in the open end position and with an exterior hood embodying another aspect of the invention mounted on the outer face of the window frame;

DETAILED DESCRIPTION OF THE EXEMPLARY EMBODIMENTS

Figure 1:
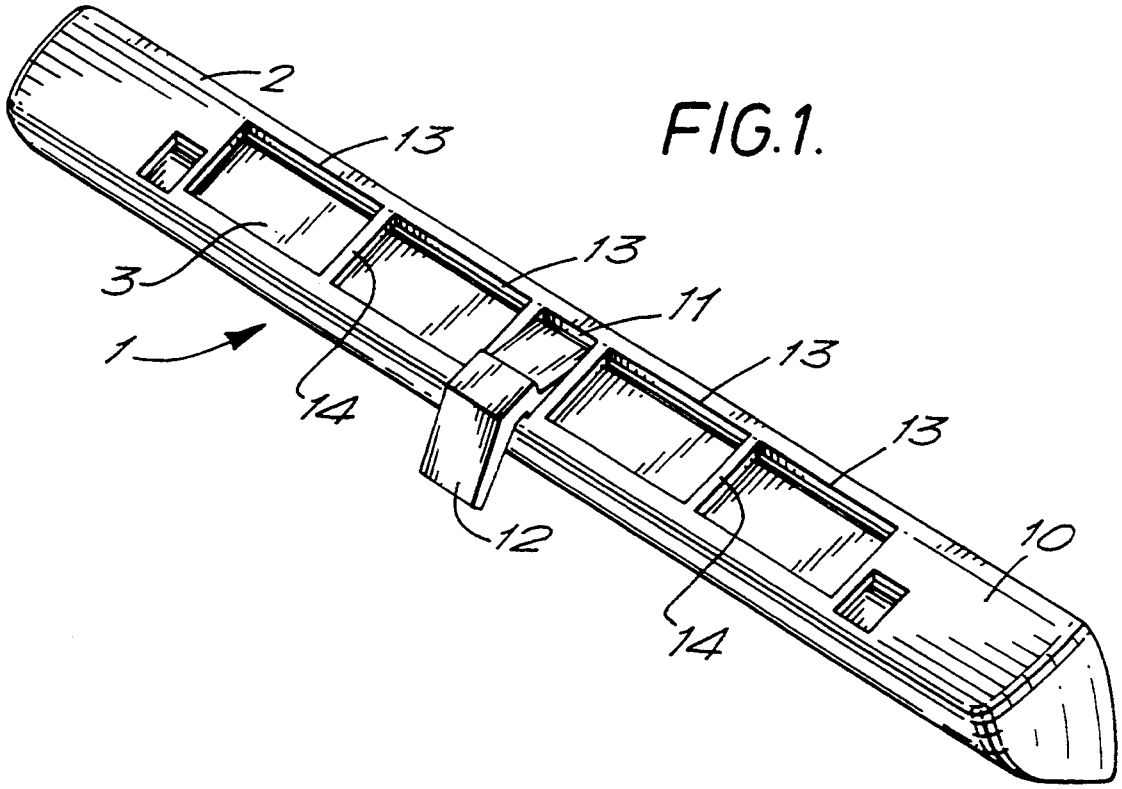
FIG. 1 is a perspective view of a ventilator embodying one aspect of the invention.

Referring first to FIGS. 1 to 4 of the accompanying drawings, the ventilator 1 comprises an elongate housing 2 and an elongate flap 3 mounted within the housing 2 for pivotal movement between two end positions shown in FIGS. 3 and 4.

The housing 2 and flap 3 each comprise a unitary plastics moulding of a size to provide a desired air flow in the open position of the flap 3 shown in FIG. 4.

The housing 2 has a planar rear face 4 and a screw hole 5 at each end for surface or face fixing to the inner face of a window frame 6 by means of screws (not shown) to overlie and conceal the marginal edge of an air path 7 extending between the inner and outer faces of the window frame 6. Moulded integrally with the housing 2 are flush fitting end caps (not shown) that are a push-fit in the holes 5 to conceal the fixing screws.

The air path 7 may comprise an elongate through slot or a series of through holes that are aligned with an elongate rectangular aperture 8 in the rear face 4 of the housing 2.

The housing 2 has a ventilation opening 9 formed in a sloping front face 10 which, in this embodiment, constitutes the upper face of the ventilator 1 so that the incoming air flow is directed upwards to reduce or prevent draughts. This is not essential, however, and the housing 2 may be inverted so that the incoming air flow is directed downwards.

The ventilator opening 9 extends on either side of a central rectangular hole 11 through which a handle 12 integral with the flap 3 projects for actuation by the user to move the flap 3 between the end positions shown in FIGS. 3 and 4.

In this embodiment, the ventilation opening 9, is subdivided into slots 13 of which there are two on each side of the hole 11 by transverse webs 14. The length and number of the slots 13 may be altered to suit the air flow requirements for different sizes of ventilator.

The housing 2 has an internal longitudinal ledge 15 on which the flap 3 is mounted along one side edge for pivotal movement between the end positions shown in FIGS. 3 and 4.

The flap 3 has an abutment 16 at each end that extends beyond the ends of the ledge 15 and is engaged by an internal spring leg 17 integral with the housing 2 that biases the flap 3 to each of the end positions shown in FIGS. 3 and 4 to close and open the ventilation opening 9 respectively.

The arrangement of the abutments 16 and spring legs 17 provides an over-centre action so that the flap 3 is positively retained in each end position. As a result, the flap 3 firmly engages the housing 2 in the closed position to prevent draughts and is prevented from accidentally closing when in the open position.

Figure 6:
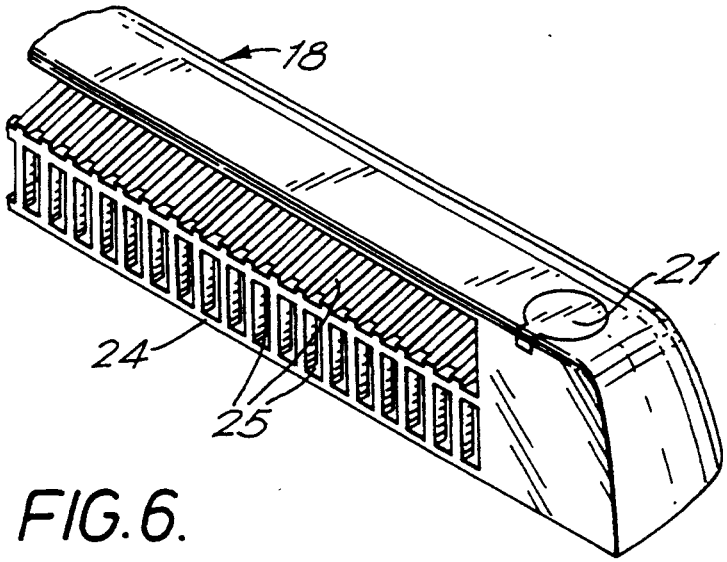
FIG. 6 is an enlarged fragmentary perspective view from below and one end of the hood shown in FIGS. 4 and 5.
Figure 2:
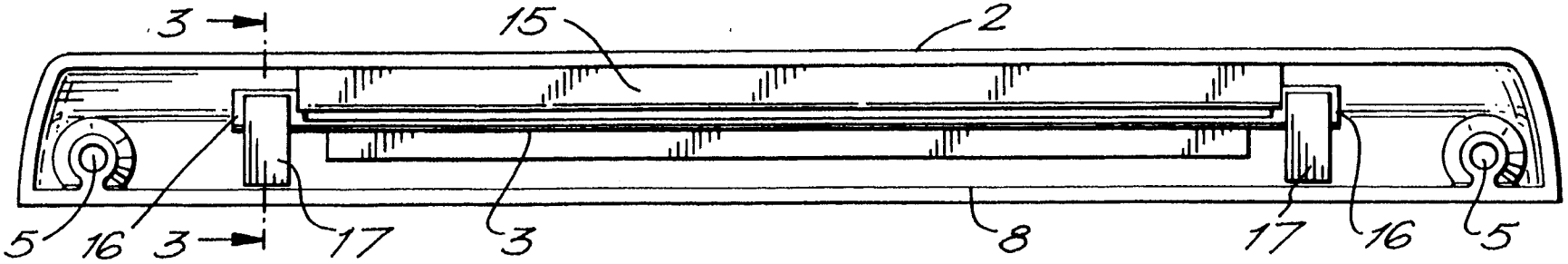
FIG. 2 is a rear view of the ventilator shown in FIG. 1.
Figure 5:
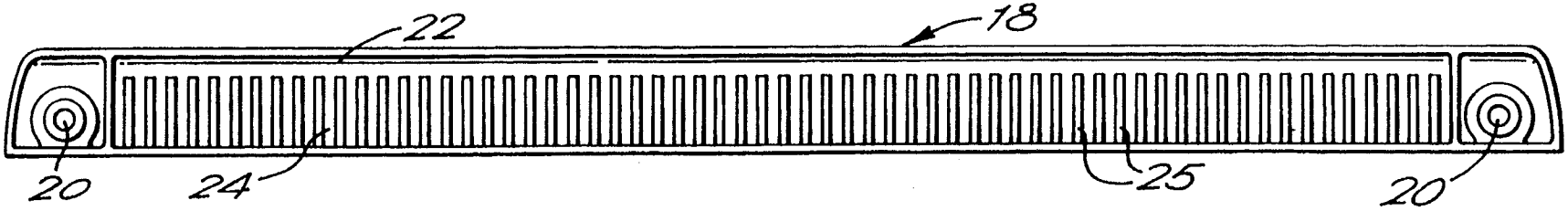
FIG. 5 is a rear view of the hood shown in FIG. 4.

With reference now also to FIGS. 5 and 6, an elongate exterior hood 18 is mounted on the outer face of the window frame 6 to overlie and conceal the marginal edge of the air path through the frame 6. The hood 18 is a unitary plastics moulding of a size and shape to provide the required air flow and the plastics material is chosen to be resistant to weathering.

The hood 18 has a planar rear face 19 for surface or face fixing to the frame 6 by means of screws (not shown) received in screw holes 20 at opposed ends of the hood 18 and concealed by flush fitting end caps 21 moulded integrally with the hood 18.

The hood 18 has an elongate rectangular opening 22 in the rear face 19 that is aligned with the air path 7 through the frame 6 and an elongate rectangular ventilation opening 23 in the underside.

The hood 18 has an integral internal grill 24 formed by two longitudinally extending arrays of narrow slots 25 which prevent entry of insects.

One array of slots 25 extends horizontally from the rear face 19 partially across the ventilation opening 23 and the other array of slots 25 extends substantially vertically upwards from the free edge of the horizontal array to the inner face of the top wall 26 of the hood 18.

By this arrangement of two arrays of slots 25 angled relative to each other, the cross-sectional area of the slots 25 is made equal to that of the ventilation opening 23 so that air flow is not restricted by the provision of the grill 24. In this way, the hood 18 does not have be made larger than necessary to obtain the required air flow.

Figure 7:
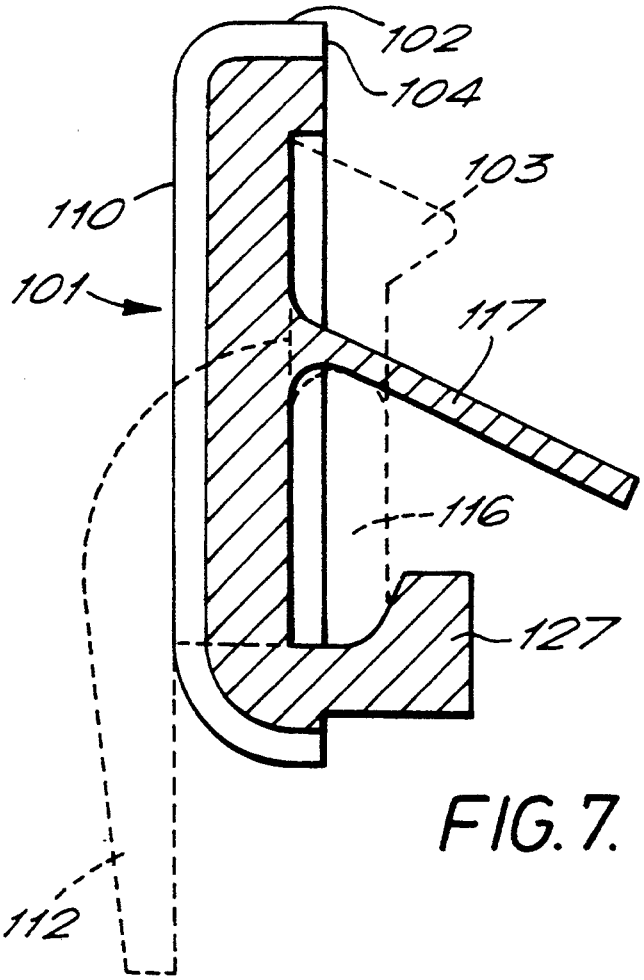
FIG. 7 is a sectional view of a modified ventilator with the flap shown in broken lines for clarity.
Figure 8:
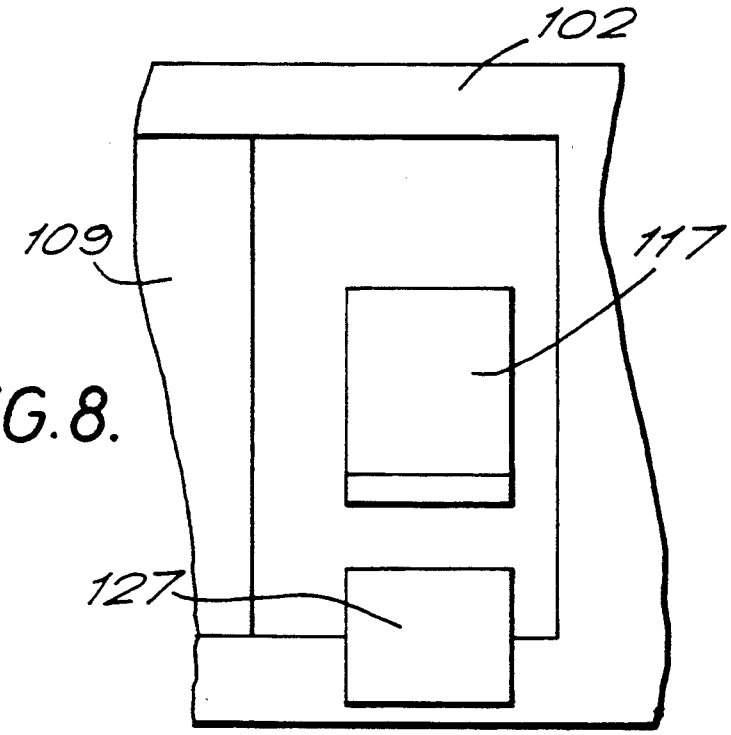
FIG. 8 is a rear view of part of the housing shown in FIG. 7.

Referring now to FIGS. 7 and 8 of the accompanying drawings, a modified slimline version of the ventilator above-described is shown in which like reference numerals in the series 100 are used to indicate corresponding parts.

The ventilator 101 has a housing 102 and a flap 103 each comprising a unitary plastics moulding. The housing 102 has a flat front face 110 in which a ventilation opening 109 is formed and a respective integral lug 127 and aligned integral spring leg 117 extending rearwardly from the front face 110 at each end of the opening 109.

Each lug 127 seats the lower edge of a respective abutment 116 at each end of the flap 103 and the aligned spring leg 117 is inclined towards the lug 127 to engage the upper edge of the abutment 116.

The flap 103 is pivotal about the lower edges of the abutments 116 to open and close the opening 109 by means of an integral handle 112 accessible externally of the housing 102 for user actuation.

The flap 103 is biased to and held in each of the closed position shown in outline in FIG. 7 and an open position (not shown) by the spring legs 117 which provide an over-centre action as the flap 103 is moved from the closed position to the open position and vice versa.

The housing 102 has a peripheral rim providing a planar mounting face 104 and a screw hole (not shown) at each end for surface or face fixing to the inner face of a window frame (not shown) by means of screws (not shown) to overlie and conceal the marginal edge of an air path extending through the frame. The fixing screws are concealed by flush fitting end caps (not shown) moulded integrally with the housing 102.

It will be understood that the invention is not limited to the embodiments above-described and that modifications can be made within the scope of the invention.

The housing may have one or more integral spring legs for biasing the flap to each end position. The or each spring leg may be provided at any position along the length of the flap. For example, a spring leg at one or both ends of the flap. Additionally or alternatively, one or more spring legs may be provided intermediate the ends of the flap.

The handle for manually moving the flap between the end positions may be positioned centrally as described or at any other position along the length of the flap.

The ventilation opening may be provided by one or more slots of a size and shape to produce any desired air flow in the open position of the flap.

The integral grill of the hood may be slotted as described or any other suitable apertures may be provided. Alternatively, other constructions of hood known to those skilled in the art may be used.

The arrays of slots or other apertures may extend substantially normal to each other as described or at any other angle.

The ventilator and/or hood may be fitted to doors or windows having an air path formed in a fixed or opening frame constructed from timber, plastics, metal or combinations thereof. Where the frame is of hollow profile a sleeve or liner may be fitted in the air path between the hood and ventilator to prevent airflow within the hollow frame profile where condensation may occur with adverse effects on any fittings concealed within the hollow frame profile, for example espagnolette gearing.

Finally, whilst the invention has been described with reference to an air path formed in a frame of a door or window, it will be appreciated that the invention has wider application and may be used in other situations where it is desired to control air flow, for example through a wall.

We claim:

1. A ventilator comprising an elongate housing and a ventilation opening formed therein, said housing having an elongate flap mounted in said ventilation opening for pivotal movement to a first position in which the ventilation opening is open or a second position in which the ventilation opening is closed, and spring means comprising at least one spring leg having a first end attached to said housing and a second end free and unattached for biasing said flap to said first and second positions.

2. A ventilator according to claim 1 wherein opposite ends of said flap are biased by respective spring legs.

3. A ventilator according to claim 1 wherein said flap has an integral grip portion accessible externally of said housing for pivoting said flap between said first and second positions.

4. A ventilator according to claim 3 wherein said grip portion is centrally located between the ends of said flap.

5. A ventilator according to claim 1 wherein said flap is pivotal about an axis extending on one side edge, and said spring means engages said flap remote from said pivot axis.

6. A ventilator according to claim 1 wherein said housing is adapted for securing to one side of a structure to overlie an air path extending between opposed sides of the structure.

7. A ventilator according to claim 6 further including a hood adapted for securing to the other side of the structure to overlie the air path.

8. A ventilator according to claim 7 wherein said hood has an integral internal apertured grill.

9. A ventilator according to claim 8 wherein said grill has first and second arrays of apertures angled relative to each other.

10. A ventilator according to claim 1 wherein said housing and flap are made of plastics.

* * * * *